United States Patent [19]

Johnson

[11] 4,259,914

[45] Apr. 7, 1981

[54] BOBBIN WINDING MECHANISM FOR A SEWING MACHINE

[75] Inventor: Ralph E. Johnson, Convent Station, N.J.

[73] Assignee: The Singer Company, Stamford, Conn.

[21] Appl. No.: 177,310

[22] Filed: Jul. 28, 1980

[51] Int. Cl.[3] ..... D05B 57/14; D05B 59/00

[52] U.S. Cl. ..... 112/184; 112/186; 112/279

[58] Field of Search ..... 112/184, 186, 228, 231, 112/279

[56] References Cited

U.S. PATENT DOCUMENTS

| | | | |
|---|---|---|---|
| 3,115,855 | 12/1963 | Ketterer | 112/184 |
| 3,693,566 | 9/1972 | Ketterer | 112/186 X |

*Primary Examiner*—Peter P. Nerbun

*Attorney, Agent, or Firm*—William V. Ebs; Robert E. Smith; Edward L. Bell

[57] ABSTRACT

A sewing machine is provided with a spring biased platform and bobbin which are movable by the throat plate of the machine into a position wherein the bobbin is disposed to receive the lower limb of a loop of needle thread and to effect an operative connection between the bobbin and drive shaft providing for rotation of the bobbin as required for bobbin winding. An electrical switch operable by the thread of a full bobbin is provided to discontinue rotation of the bobbin drive shaft.

11 Claims, 18 Drawing Figures

Fig. 15.
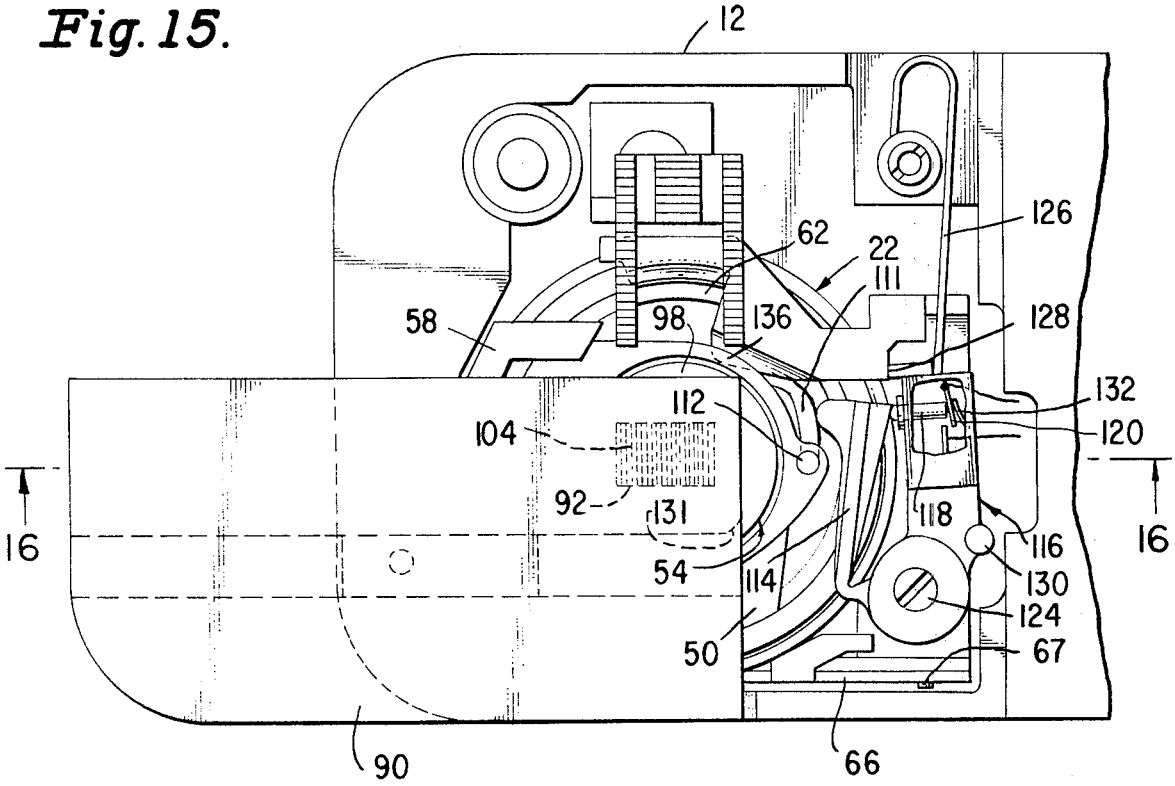
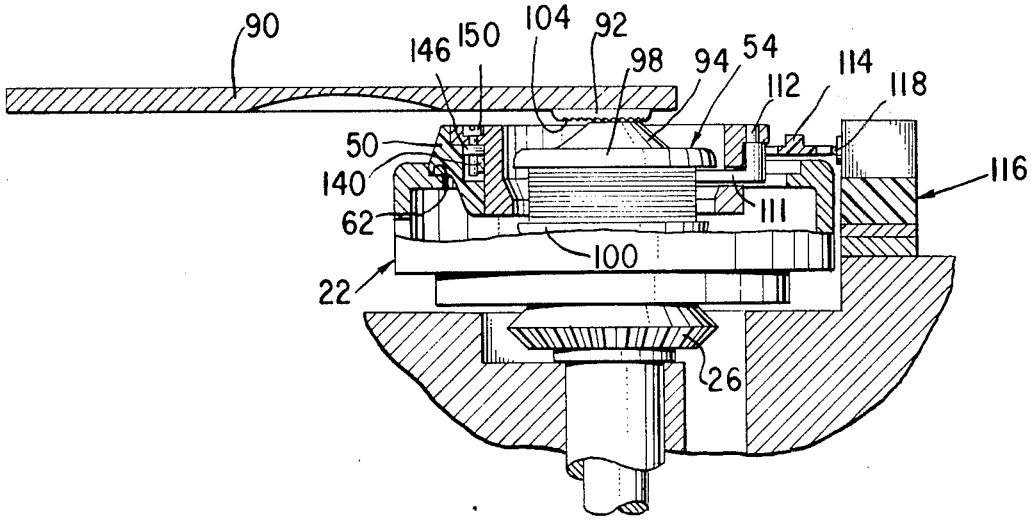
Fig. 16.

BOBBIN WINDING MECHANISM FOR A SEWING MACHINE

DESCRIPTION

BACKGROUND OF THE INVENTION

1. Field of the Invention

The invention releates to bobbin winding mechanism for a sewing machine and more particularly to mechanism for replenishing thread on a bobbin while in place in a looptaker.

2. Description of the Prior Art

Mechanisms for replenishing thread on a bobbin while in place in a looptaker and while stitch forming instrumentalities remain operatively associated as required for sewing are well known. Such bobbin replenishing mechanisms may be seen for example in U.S. Pat. No. 3,115,855 of S. J. Ketterer for "Bobbin Thread Replenishing Means in Sewing Machine Loop Taker" issued Dec. 31, 1963, and in U.S. Pat. No. 3,693,566, also of S. J. Ketterer for "Bobbin Thread Replenishing Mechanism for Sewing Machines" issued Sept. 26, 1972.

A disadvantage of prior art bobbin thread replenishing mechanisms of the kind described has been their complexity and cost, due to the inclusion of camming devices for raising and lowering a drive shaft into and out of driving engagement with the bobbin. Further, the prior art mechanisms included threading devices which often proved difficult to thread.

It is a prime object of the present invention to provide an improved bobbin winding mechanism which can be simply and inexpensively constructed.

It is another object of the invention to provide an improved bobbin winding mechanism which is constructed to facilitate the threading of a tensioning device.

It is still another object to provide improved means for initialing and discontinuing the operation of bobbin winding mechanism.

Other objects and advantages of the invention will become apparent hereinafter.

SUMMARY OF THE INVENTION

In accordance with the invention a sewing machine having a vertical axis looptaker for seizing and moving a needle thread loop about a non-rotatable bobbin case which nests within the looptaker is provided with a spring biased platform to support a bobbin in the bobbin case. The bobbin is depressable by a partially open throat plate into a position for receiving the lower limb of a loop of needle thread and for effecting an operative connection between the bobbin and a drive shaft providing for rotation of the bobbin as required for the bobbin to seize and wind needle thread on the bobbin post. Rotation of the bobbin is discontinued by operation of a switch when actuated by the thread of a full bobbin acting through a movable member mounted on the bobbin case.

The bobbin case is provided with an adjustable thread tensioning device close to the sewing needle, and with a thread receiving slot which extends into the path of the upper loop of needle thread when the bobbin is depressed. Such slot guides the thread for capture by the tensioning device.

DESCRIPTION OF THE DRAWINGS

in FIG. 7 during the expansion of a loop of thread by the looptaker after seizure thereby, in FIG. 8 just after cast-off of the expanded loop of thread from the looptaker, in FIG. 9 shortly after seizure of the thread by the bobbin the winding of thread thereon, in FIG. 10 after the winding of several loops of thread on the bobbin, in FIG. 11 after the capture of thread by a thread tensioning device on the bobbin case and the severance of thread on the bobbin, and in FIG. 12 after the continued winding of thread on the bobbin;

FIG. 15 is a view similar to FIG. 2 showing the throat plate in a position for bobbin winding;

FIG. 16 is a sectional view on the plane of the line 16—16 of FIG. 15;

Figure 1:
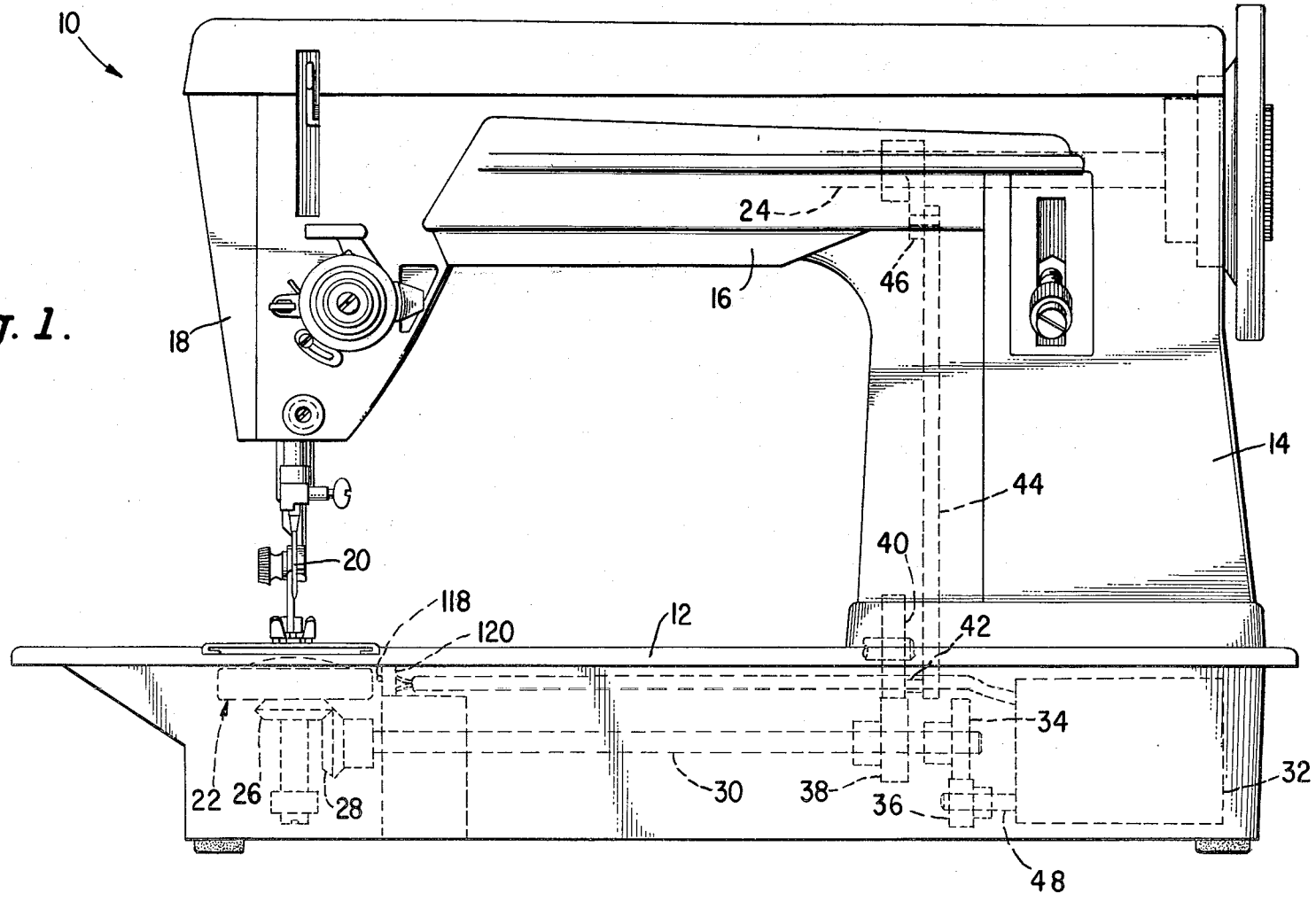
FIG. 1 is a side elevational view of a sewing machine including the bobbin winding mechanism of the invention.

Referring to the drawings, and in particular to FIG. 1 reference character 10 designates a lockstitch sewing machine incorporating the invention. The machine includes a bed 12, a standard 14 rising from the bed, a bracket arm 16 extending over the bed, and a head end portion 18 which depends from the bracket arm. Stitching instrumentalities of the machine include a endwise reciprocable sewing needle 20, as well as a vertical axis looptaker 22 which is preferably driven at a speed of two or three revolutions for each reciprocation of the needle.

The needle operably connects with conventional needle reciprocating mechanism (not shown) in the head end portion 18 and thereby with an arm shaft 24 located in the bracket arm 16. The looptaker operably connects through bevel gears 26 and 28 with a bed shaft 30. As shown, the bed shaft operably connects with a motor 32 in the bed 12 through gears 34 and 36, and the bed shaft connects with the arm shaft through gears 38 and 40, a crank 42, rod 44, and a crank 46. Rotation of the motor shaft 48 results in endwise reciprocatory motion of the needle 20, and in rotary motion of the looptaker in timed relation to reciprocation of the needle.

Figure 2:
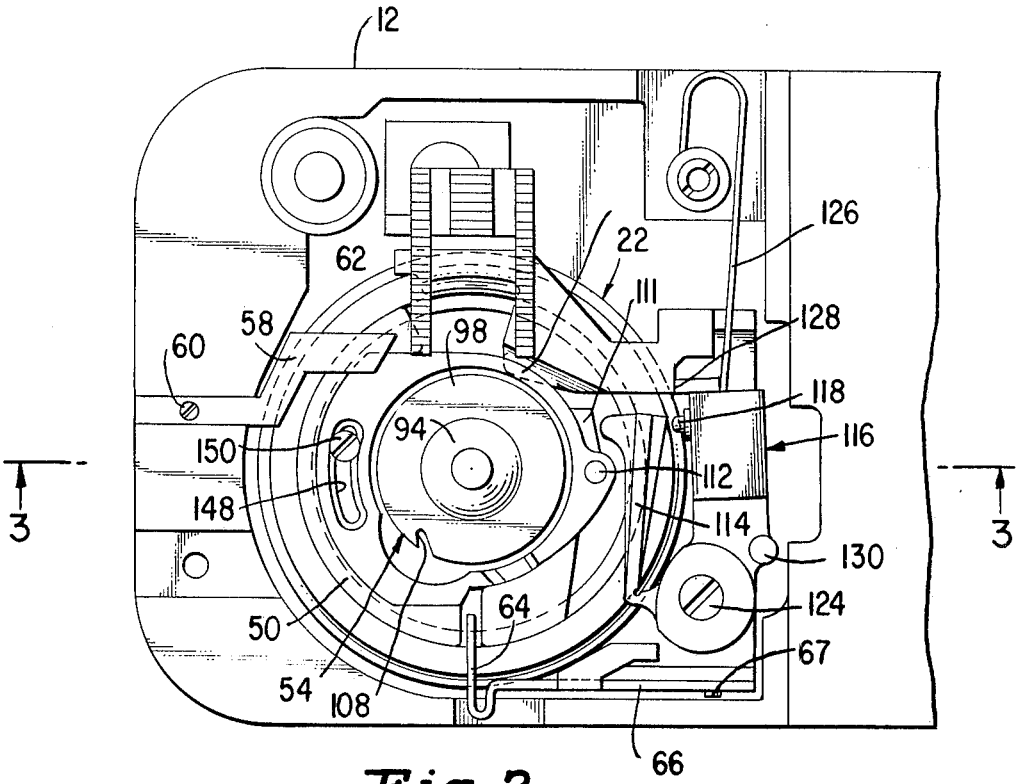
FIG. 2 is an enlarged fragmentary top plan view of a portion of the bed of the machine from which the feed cover and throat plate have been removed to show the looptaker.

A bobbin case 50 nests in the looptaker 22 (see FIGS. 2 and 3) where it is supported above a platform 52. A bobbin 54 within the looptaker is supported on the platform as shown. The platform is biased upwardly by a spring 56 having opposite ends in contact with the platform and looptaker. A tab 58 secured in the bed by a screw 60 and overlapping the bobbin case maintains the bobbin case against a ledge 62 on the looptaker, and a finger 64 on a member 66 pivoted in the bed at 67 prevents the bobbin case from rotating.

The looptaker 22 includes, as an integral part thereof, a hollow depending shaft 68, a tubular member 70 having a closed end 72, and a rod 74 which is secured to the tubular member by engaging threads 76 and 78. The tubular member includes a key 80 which is slidable in a key way 82 in shaft 68 and is movable with the rod 74 downwardly in the shaft 68 against a spring 84 located between the closed end 72 of the tubular member and a plug 85 in the bottom of the shaft. Tubular member 70 and the rod 74 secured thereto are also rotatable in the bed 12 by the looptaker shaft 68 acting through key 80. The upper end of rod 74 is provided with a key 86 to engage the bobbin 54 in a cross-keyway 88 during bobbin winding (see FIG. 5).

Figure 3:
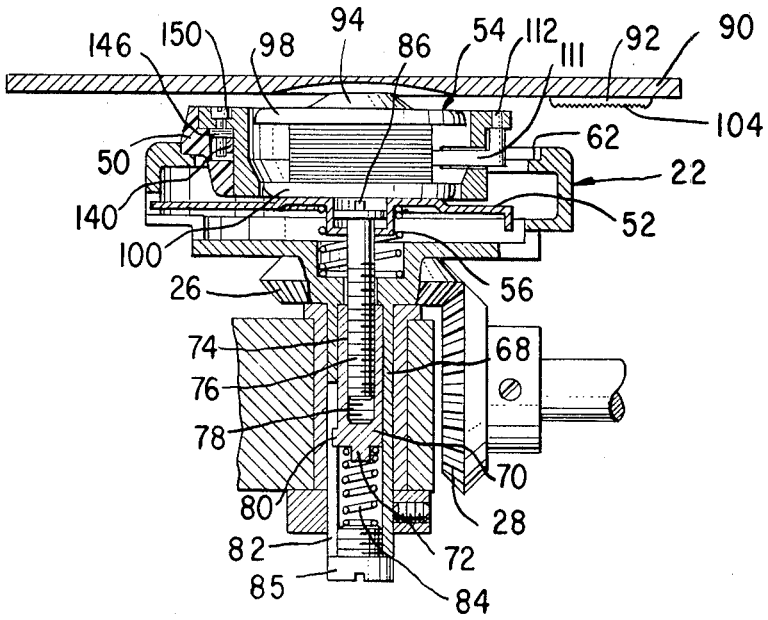
FIG. 3 is a fragmentary vertical sectional view taken through the bed substantially on the plane of the line 3—3 of FIG. 2.
Figure 4:
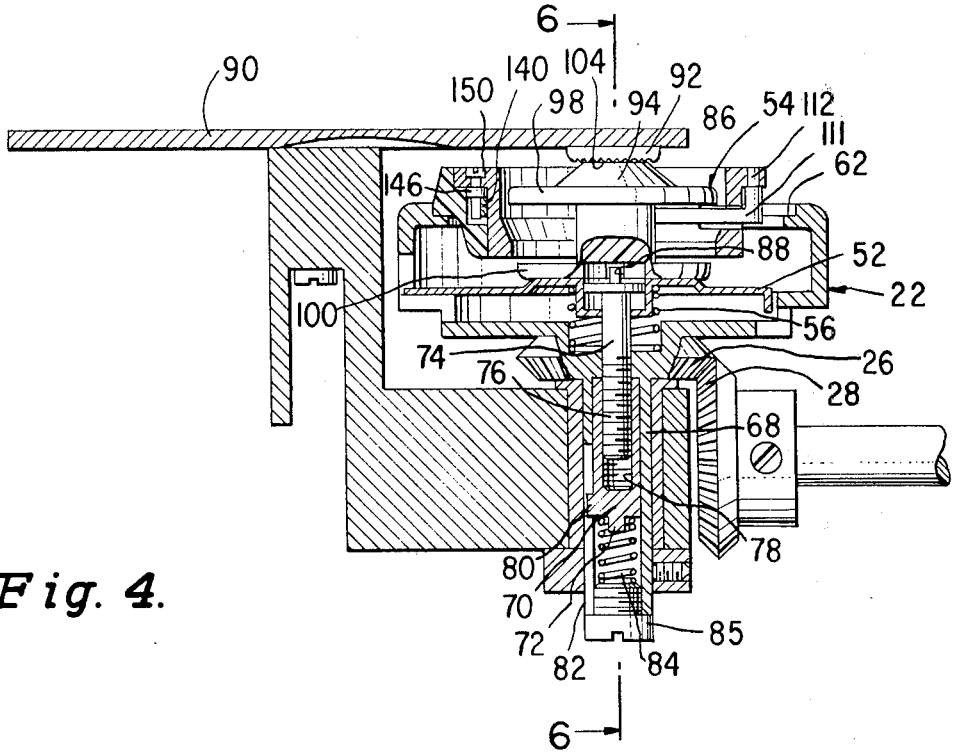
FIG. 4 is a view similar to FIG. 3 showing the bobbin winding mechanism in condition for bobbin winding.

The bobbin is shown in FIG. 3 in its normal position for all sewing operations during which the looptaker 22 is rotated by the bed shaft 30 acting through bevel gears 28 and 26, and rod 74 with the its cross-key 86 disengaged from bobbin 54 is rotated by the looptaker. When it is desired to wind thread upon a depleted bobbin, the tag end of the needle thread is held or otherwise anchored and the bobbin is moved downwardly within the bobbin case to a depressed position by movement of a throat plate 90 to a partially open position wherein a cam 92 on the underside of the throat plate is caused to engage a central protuberance 94 on the bobbin (see FIG. 4). Pressure of the cam 92 on the bobbin causes the platform 52 to move downwardly against spring 56 and both the bobbin 54 and platform 52 assume the positions indicated in FIG. 4. Depression of the bobbin and platform results in the cross-key 86 on rod 74 entering cross-keyway 88 as rotation of the cross-key brings it into alignment with the keyway (if not already aligned), whereupon the bobbin 54 is rotated with the looptaker 22 by the looptaker shaft 68 acting through key 80 on the tubular member 70 in which rod 74 is affixed.

Figure 6:
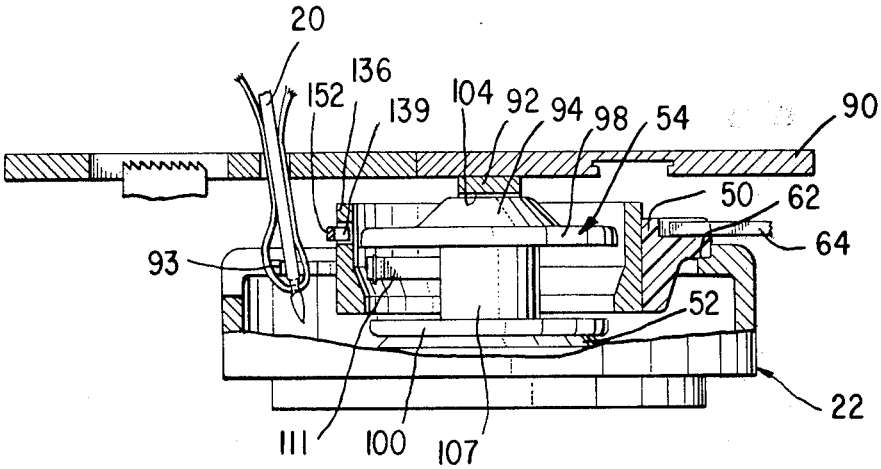
FIG. 6 is a fragmentary vertical sectional view taken on the plane of the line 6—6 of FIG. 4 showing the bobbin winding mechanism in condition for bobbin winding and a needle thread loop presented for seizure by the looptaker.
Figure 7:
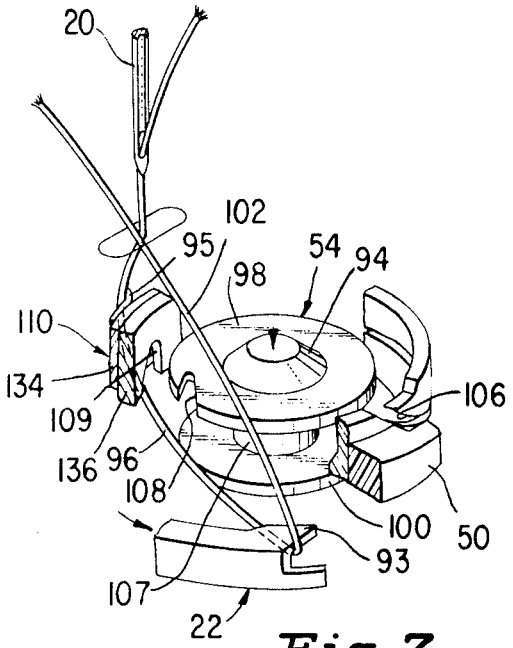
FIGS. 7, 8, 9, 10, 11 and 12 are schematic perspective views showing the looptaker and/or bobbin in various positions providing for the replenishment of thread on the bobbin.
Figure 8:
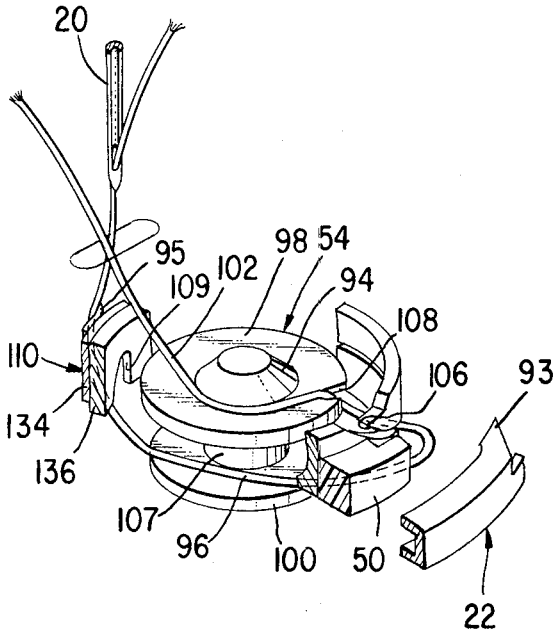
Figure 9:
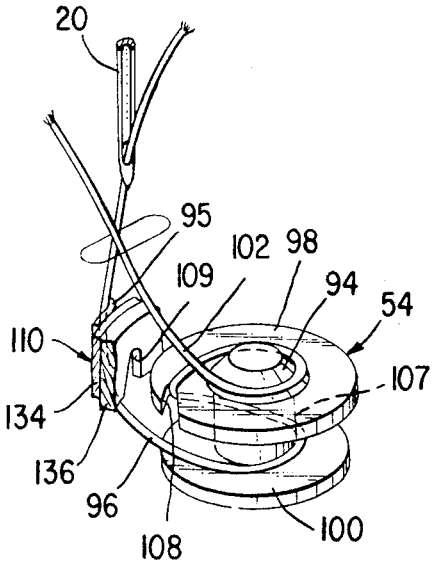
Figure 10:
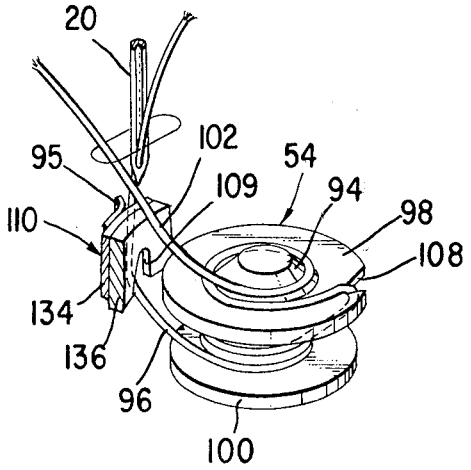
Figure 11:
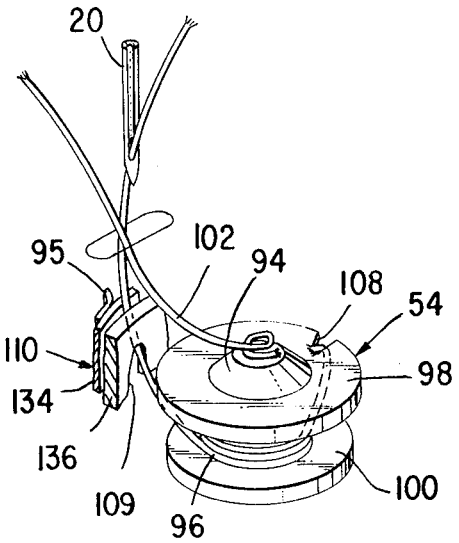
Figure 12:
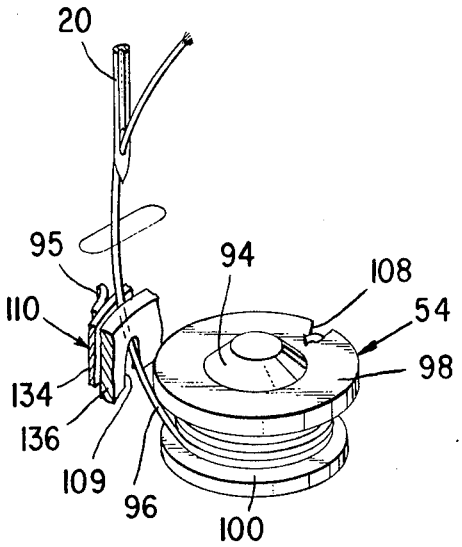

The first step in the winding of a bobbin after the bobbin has been depressed as described, is the seizure of a loop 91 of needle thread by the hook 93 of the looptaker (FIG. 6). The loop 91 is expanded with rotation of the looptaker onto a thread guard 95 on the bobbin case and a lower limb 96 of the loop is caused by the looptaker to enter the bobbin 54 between its flanges 98 and 100 (see FIGS. 7 and 8). An upper limb 102 of the needle thread loop is moved into a position against bobbin protuberance 94 under throat plate cam 92 where it is held until severed as hereinafter described. When the looptaker has travelled to slightly more than 180° beyond loop seizure, the thread is pulled off the hook 93 of the looptaker by operation of the takeup of the machine and caused to enter the upper end of thread guiding slot 106 in bobbin case 50 where the thread remains until grabbed by a notch 108 in the rotating bobbin (FIG. 8). The upper limb 102 of the thread is then moved by the bobbin through the slot 106 to the bottom of the bobbin case. The bobbin begins winding thread on the bobbin post 107 (FIG. 9) and when the needle 20 descends the thread is pulled off thread guard 95 (FIG. 10). When the needle moves upwardly the thread is pulled by way of a bobbin case notch 109 into a thread tensioning device 110 located close to the path of the sewing needle (FIG. 11). As the bobbin continues to rotate, needle thread is pulled from a supply through the tension device and wound on the bobbin (FIGS. 11 and 12). Thread loop 102 is severed at a saw-toothed surface 104 (FIG. 4) on tab 92.

As the bobbin becomes fully wound, the thread on the bobbin comes into contact with and moves a member 111, pivoted in the bobbin case at 112, against the resilient arm 114 of a plastic switch holding device 116 (see FIGS. 15 and 16). The arm 114 acts against a plunger 118 which opens a normally closed switch 120 in device 116 and thereby an energizing circuit for the motor 32 of the machine to discontinue bobbin winding. An operator then readies the machine for sewing by moving the throat plate 90 from the partially closed position to a completely closed position. As the throat plate 90 is moved from its partially closed position, cam 92 is moved off the protuberance 94 on the bobbin flange 98, whereupon platform 52 and bobbin 54 are moved upwardly by spring 56 to their FIG. 3 positions and the bobbin is disengaged from cross-key 88 for free rotation within the bobbin case. As the throat plate moves further into the closed position it causes switch 120 to close.

As may be seen in FIGS. 15 and 16 the switch holding device 116 is pivoted at 124 in the bed 12 of the machine. A strong spring 126 maintains the device against a stop 128 except when the throat plate 90 is moved to the fully closed position. When the throat plate is so moved a pin 130 on the device is engaged by a camming surface 131 on the underside of the throat plate. The device 116 is pivoted away from member 111 and arm 114 is disengaged from plunger 118 whereupon switch 120 is closed by a spring 132.

After the throat plate has been closed and while thread extending to the bobbin and through the needle is temporarily held taut to one side of the needle by an operator, the machine can be operated as with a foot controller 122 to initiate the formation of lockstitches in a material under the needle. Lockstitches are formed on the machine in a manner well understood in the sewing art. The hook 93 of the looptaker 22 seizes a loop of thread from the needle and carries it around the bobbin case which separates the loop into upper and lower limbs. The upper limb is moved over the bobbin case and passes over bobbin case slot 106 because of the raised position of the bobbin 54 during sewing. The lower limb is moved under the bobbin case. After the looptaker has completed slightly more than one half revolution beyond loop seizure, the loop is cast off the hook 93 by action of the take up of the machine and drawn about the bobbin thread to concatenate the needle thread with the bobbin thread.

Figure 5:
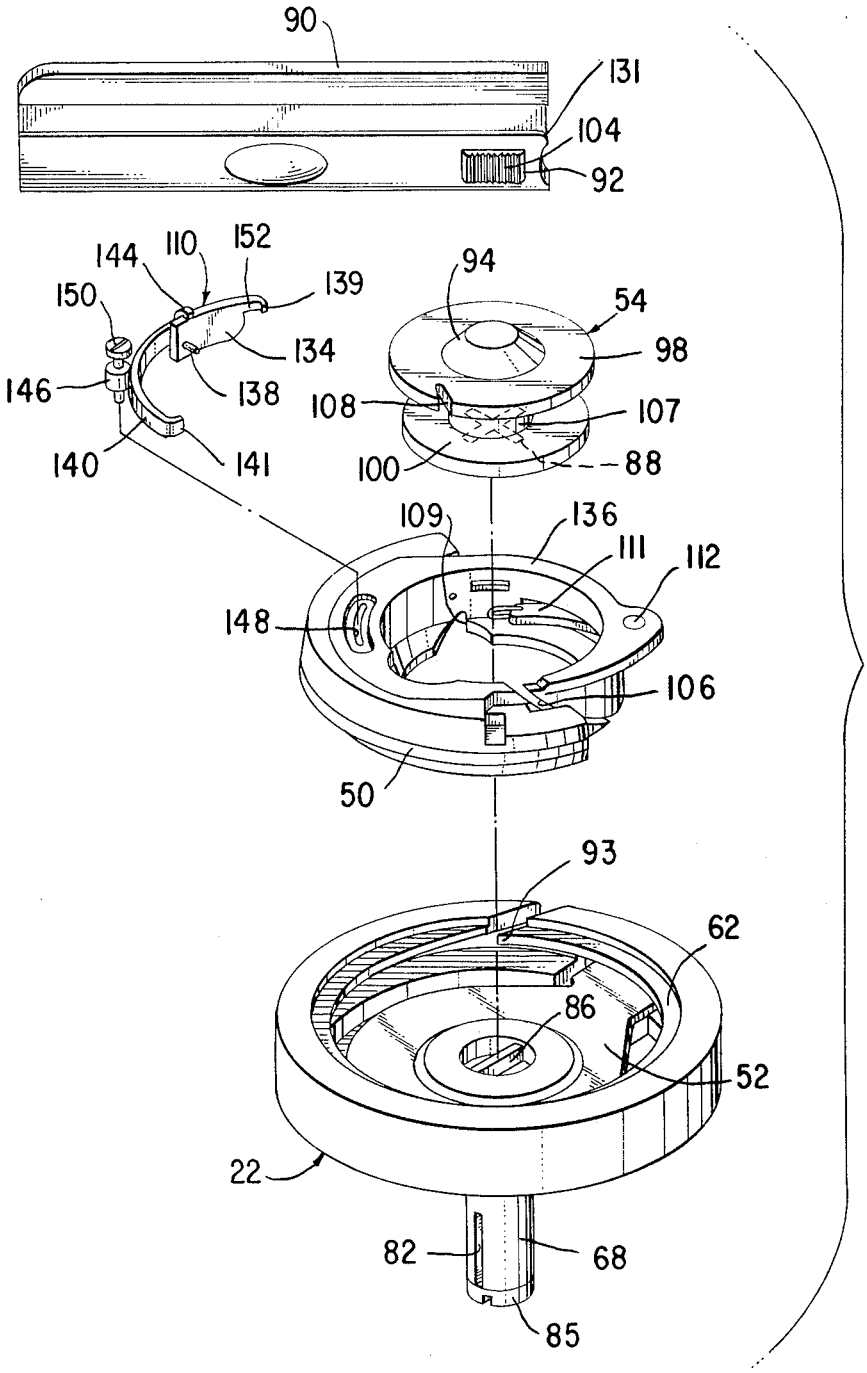
FIG. 5 is an exploded perspective view of the bobbin winding mechanism.
Figure 13:
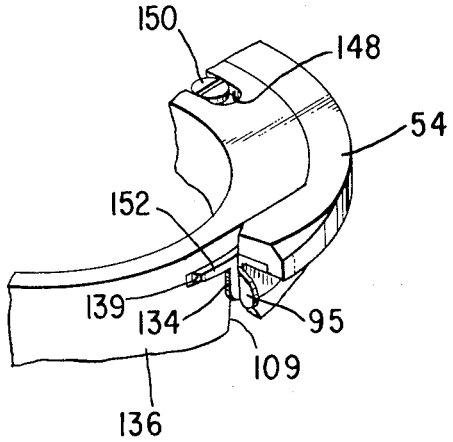
FIGS. 13 and 14 are fragmentary perspective views showing the tension device on the bobbin case.
Figure 14:
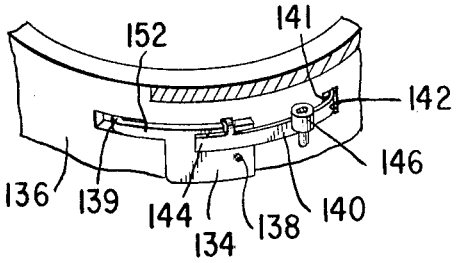
Figure 17:
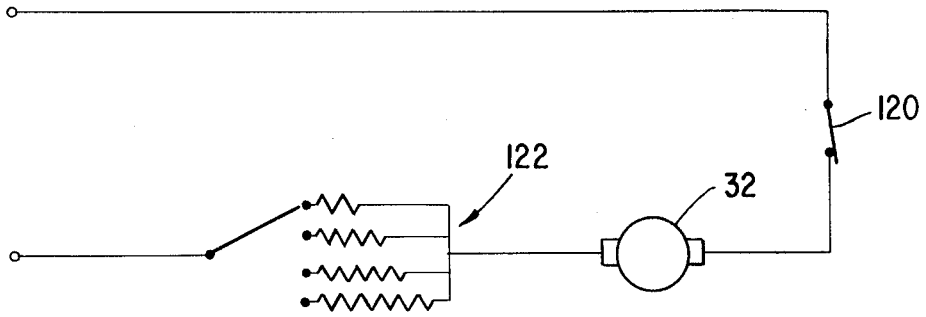
FIG. 17 is a somewhat diagrammatic illustration of a control circuit for the machine.

Thread moving through the tension device 110 during bobbin winding or during a sewing operation extends under a tension plate 134 which presses the thread against a depending rim 136 of the bobbin case (see FIGS. 5, 13 and 14). While thread is being pulled by the bobbin through the tension device during bobbin winding, it is also being moved up and down therein by needle 20 and undue wear at any particular location on the tension plate is prevented. The plate is loosely connected to rim 136 radially inward from thread guard 95 by pin 138 and tab 139. An elongated member 140 extends at one end 141 into a hole 142 in rim 136 and engages at its other end 144 the tension plate 134. A cam 146 is selectively positionable along member 140 and in an annular bobbin case slot 148 wherein the member may be secured by a screw 150. Tension in thread moving through device 110 is adjusted by the positioning of cam 146. Tension plate 134 is provided with a guard 152 to limit the upward movement of thread in the tension device.

Figure 18:
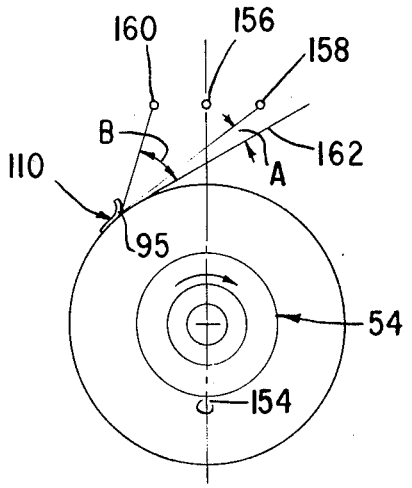
FIG. 18 is a schematic illustration depicting the position of the tension device on the bobbin case relative to needle stitching positions.

The tension device 110 is located to one side of the front-to-rear looptaker center line 154, as shown in FIG. 18, to provide for rotation of the bobbin in a direction opposite to the rotation of the looptaker as thread is pulled from the bobbin by takeup mechanism during stitch formation. The looptaker center line 154 extends through a straight stitching path 156 for needle 20 between possible zig-zag needle positions 158 and 160. During zig-zag stitching increased frictional drag is experienced by the bobbin thread during stitch setting at the exit point of the thread from the thread tensioning device and less in the material when the needle is in the left zig-zag position (as viewed in FIG. 18). The tension device is therefor preferably located in a compensating position with angles A and B between a tangent 162 to the bobbin at the thread tension device and bobbin thread extending to zig-zag stitch positions such as to result in substantially the same net tension in the bobbin thread for either angle as bobbin thread is pulled upwardly by takeup mechanism to set a stitch. Unbalanced stitches and the puckering of material when zig-zag stitches are sewn is thereby prevented.

A particular preferred embodiment of the invention has shown and described by way of illustration, however many modifications will occur to those skilled in the art, and it is to be understood that is is intended to cover all changes and modifications falling within the true spirit and scope of the invention as set forth in the annexed claims.

I claim:

1. In a sewing machine, the combination comprising a reciprocable needle, a rotatable vertical axis needle thread looptaker, a bobbin case nested in the looptaker; means restraining the bobbin case from rotating, a bobbin in the bobbin case, a spring biased platform which supports the bobbin in the bobbin case, a bobbin winding drive shaft, and a throat plate movable over the bobbin and engageable in a partially closed position with the bobbin for depressing the bobbin and platform into a position wherein the bobbin is in driving engagement with the bobbin drive shaft and the bobbin is disposed to receive for bobbin winding the lower limb of a loop of needle thread moved about the bobbin case by the looptaker.

2. The combination of claim 1 wherein the bobbin includes an upper flange with a notch in the edge thereof to capture the upper limb of said loop of needle thread for bobbin winding.

3. The combination of claim 1 wherein the throat plate includes means for holding the upper limb of thread against said flange of the bobbin when the plate is in the partially closed position.

4. The combination of claim 1 wherein the bobbin case includes a thread tensioning device in close proximity to the path of the needle.

5. The combination of claim 2 wherein the bobbin case includes a slot for guiding the upper limb of said loop of needle thread when the bobbin is depressed to the bottom of the bobbin case for capture by the thread tensioning device.

6. The combination of claim 3 wherein the tensioning device is adjustable.

7. The combination of claim 1 wherein the bobbin case includes a thread tensioning device and a thread receiving slot, the slot having a thread receiving end which is in the path of the upper limb of said loop of needle thread when the bobbin is depressed and which extends therefrom in a direction to guide thread to the bottom of the bobbin case for capture by the tensioning device.

8. The combination of claim 7 wherein the thread tensioning device is adjustable and includes a tension setting control member movable in an arc on the bobbin case.

9. The combination of claim 1 including means for driving the bobbin drive shaft, a movable member on the bobbin case actuable by the thread of a full bobbin, and means for controlling the bobbin shaft driving means including a switch operable by the said movable member for causing the said driving means to discontinue bobbin drive shaft rotation.

10. The combination of claim 9 wherein the driving means for the bobbin drive shaft includes an electric motor, and operation of the switch by said movable member on the bobbin case deenergizes the motor.

11. The combination of claim 9 wherein the throat plate includes means for rendering the switch inoperative by said movable member on the bobbin case when the throat plate is closed.

* * * * *